United States Patent [19]

Sahores

[11] 4,159,437

[45] Jun. 26, 1979

[54] X-RAY EMITTER TUBE HAVING AN ANODE WINDOW AND METHOD OF USING SAME

[75] Inventor: Jean Sahores, Buros, France

[73] Assignee: Societe Nationale Elf Aquitaine (Production), Paris, France

[21] Appl. No.: 806,167

[22] Filed: Jun. 13, 1977

[30] Foreign Application Priority Data

Jun. 14, 1976 [FR] France ..... 76 17949

[51] Int. Cl.[2] ..... H01J 35/00; H01J 35/32

[52] U.S. Cl. ..... 313/59; 250/492 R; 313/330

[58] Field of Search ..... 250/492 R; 313/59, 330

[56] References Cited

U.S. PATENT DOCUMENTS

| | | | |
|---|---|---|---|
| 2,896,105 | 7/1959 | Hosemann | 313/59 |
| 3,224,432 | 12/1965 | Billingsley | 250/492 R |

*Primary Examiner*—Alfred E. Smith
*Assistant Examiner*—T. N. Grigsby
*Attorney, Agent, or Firm*—Brisebois & Kruger

[57] ABSTRACT

High efficiency X-ray irradiation device and method of using same comprising a transmission tube equipped with a high voltage cathode which faces an anode window. The anode itself is in the form of a thin metallic shell applied to the internal surface of a thin window which is transparent to X-ray radiation. The sample to be irradiated has an irradiation surface, which is placed opposite to and surrounds the face of the anode window. Both the window and the irradiation surface of the sample are formed by continuous surfaces. When performing the method, each of these surfaces is arranged such that if is bounded by a closed curve located in the plane which intersects the zone in which the window is attached to the tube envelope or casing.

13 Claims, 4 Drawing Figures

X-RAY EMITTER TUBE HAVING AN ANODE WINDOW AND METHOD OF USING SAME

The present invention relates to an X-ray irradiation device having an X-ray emitter tube comprising a high voltage cathode, located within the tube envelope, and an anode window. The device is adapted to be used particularly for X-ray spectrometry of a material.

The various X-ray spectrometry analysis techniques in use normally require that the wavelength of the X-ray radiation be as close as possible to the discontinuity limit of the spectrum of the element which is to be excited in the given sample or material.

Known X-ray emitters normally comprise a hot cathode, generally connected to a high voltage source, as well as an anode which is grounded to the device and which is located near a window. The window is made of a material transparent to X-rays. Such emitters provide high intensity radiation having wave lengths which are a function of the metal used for the anode, and a continuous ground spectrum produced by the backscattering of electrons from the surface of the anode, or bremsstrahlung.

Furthermore, in operating an X-ray emitter, the quality of the analysis as well the high energy efficiency which is desired require that the intensity of radiation at the lower end of the continuous spectrum be reduced.

A device has been proposed having its anode arranged in a manner such that the surface receiving the electron flux and emitting the X-rays is parallel to and as close as possible to the window of the tube. As compared with tubes having anodes arranged at an angle to their windows, the proposed device achieved improved transmission characteristics through the window. However, such a device also inherently possesses the disadvantage of directing a major part of the backscatter radiation towards the window. As a result the window becomes heated. In spite of the use of cooling means, it has been found that the windows are not able to easily withstand the effects of the heat.

Accordingly, to overcome this problem a lamellar emitter has been proposed which received the flux of electrons on one of its sides and emits the X-ray radiation from its other side. Good mechanical support of such a very thin anode necessitated that the anode be applied against the internal face of the window.

Tubes such as these, having anode windows, achieve excellent transmission of X-rays through the window towards the sample. However a considerable continuous ground spectrum persists because the backscattering of electrons from the surface of the anode occurs freely.

It is thus an object of the invention to overcome the above recited inconveniences accompanying previously used devices and to provide a device which provides quasi-monochromatic radiation at high efficiency.

It is a further object of the invention to provide a device which is arranged such that the major portion of the backscattered electrons contact the anode a second time thus causing a second emission, and possibly a third emission of X-rays.

However, when such a tube is used to irradiate a planar sample the resulting efficiency is relatively low.

It is thus an additional object of the invention to take full advantage of the high efficiency of the emitter by using a tube which has an anode window in the shape of a dome to irradiate samples whose surface to be irradiated is in the form of an elongated dome. The window is thus inserted within the dome of the sample.

The method of the invention has as its object the irradiation of a material with X-rays. A concave irradiation surface is provided within the material and an X-ray emitter having an envelope containing a cathode and an anode is used to irradiate the material. The anode is attached along the inner surface face of a window located at one end of the envelope. The window is a shell having a concave internal face and a convex external face which is connected to the envelope along an attachment zone located within an attachment plane. The window is positioned with respect to the material such that it projects into the irradiation surface of the material. The emitter is then activated so as to irradiate the irradiation surface of the material.

In carrying out the method it has proved to be an advantage to arrange the sample with respect to the device such that the irradiation surface of the material meets with the attachment plane of the window. In such cases the process has been additionally refined such that the material to be irradiated is arranged such that the irradiation surface meets with the attachment plane to form a closed curve which entirely surrounds but does not intersect the attachment zone of the window. Furthermore, the material is arranged such that the internal and external faces of the window as well as the irradiation surface of the material each share a common axis of symmetry.

In the above method of practicing the invention, the corresponding dimensions of the closed curve formed by the intersection of the irradiation surface with the attachment plane of the window, and the external outline of the attachment zone of the window are in a ratio of about 1.5:1 to about 5:1, preferably between 2:1 to about 4:1.

The device of the invention for irradiating the surface of a material with X-rays comprises an X-ray emitter tube having a tube envelope maintained under a strong vacuum (low pressure). The device has a window consisting of a thin shell of material which is transparent to X-rays. The shell has an internal as well as an external face and is attached to the envelope along a narrow zone called an attachment zone. The attachment zone is located substantially within a plane called the attachment plane of the window. A cathode is provided which is connected to high voltage source and which has a surface called an emission surface. An anode which is grounded to the device comprises a thin metallic shell which is applied over the internal face of the window.

The combination of the invention comprises the above device in combination with the material to be irradiated. The material to be irradiated is supported on a support. The material or sample as it is sometimes known has a surface called an irradiation surface which faces the window of the X-ray emitter. The emission surface of the cathode, the internal and external faces of the window and the irradiation surface of the sample are each arranged such that they have a common axis of symmetry. The device is characterized in that the internal face of the window has a concave shape, the external surface of the window has a convex shape and the irradiation surface of the material has a concave shape. The tube is arranged with respect to the irradiation surface of the material such that the surface meets the attachment plane of the window along a closed curve which entirely surrounds, but does not contact the attachment zone of the window.

In one preferred embodiment of the invention the irradiation surface of the sample extends at least as far as the closed curve formed by the intersection of the irradiation surface of the material with the attachment plane of the window.

In each of the embodiments, the corresponding dimensions of the closed curve, formed by the intersection of the irradiation surface with the attachment plane of the window, and the external outline of the attachment zone of the window are in a ratio of about 1.5:1 to about 5:1. The preferred ratio being between about 2:1 and 4:1.

In various embodiments, the faces of the window, i.e., internal concave face and external convex face, as well as the concave surface of irradiation of the material each are in the shape of an elongated dome formed by a continuous surface and bounded by a closed curve located substantially within the attachment plane of the window.

In other embodiments of the invention the internal and external faces of the window as well as the surface or irradiation of the material each have a frustoconical shape, i.e., a major and a minor base, each having a closed outline. The outline forming the major base is located substantially in the attachment plane of the window. The frustroconical portions are each characterized by a half angle at the apex having a value between about 10° and 60° and a planar surface bounded by the minor base of the frustroconical surface.

In yet other embodiments the internal and external faces of the window are each in the form of an elongated dome describing a continuous surface and bouded by a closed curve located in the attachment plane of the window. In such cases the irradiation surface of the sample is in the shape of a frustoconical section having a major and a minor base, each of which has a closed periphery. The major base has its edge located in the attachment plane of the window, the frustroconical section being characterized by a half-angle at the apex of between about 10° and about 60° and by a dome which is attached to the frustroconical surface along the edge of the minor base.

Although modification is of course possible, in order to facilitate manufacture, the internal and external faces of the window as well as the irradiation surface of the sample are continuous surfaces bordered by a closed curve located in the attachment plane of the window, the said continuous surfaces each being of revolution around the axis of symmetry, i.e., the surfaces can be generated geometrically by rotation of a line or curve around an axis.

The invention will be better understood by way of the description which follows, with the aid of the attached figures illustrating several examples of irradiation devices having an X-ray emitter outfitted with an anode window. It should of course be understood that these embodiments are merely exemplary and that the invention is not limited to the devices illustrated.

Essentially, each of the drawings illustrates the same elements which make up the invention.

Figure 1:
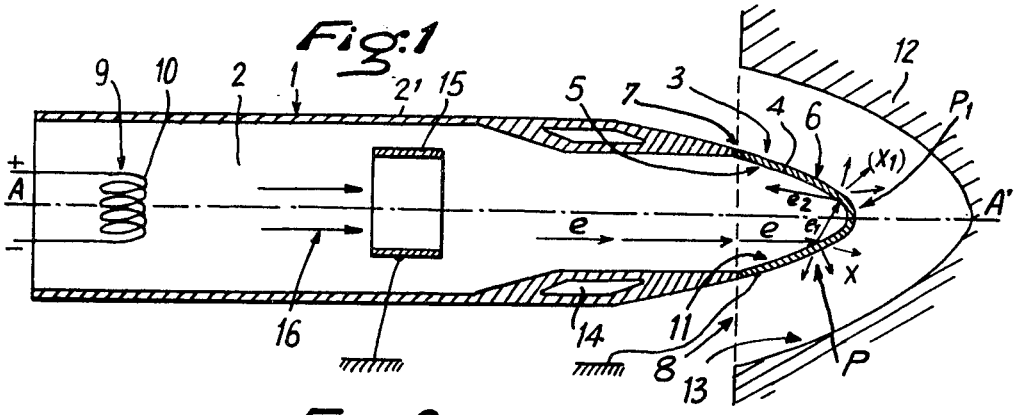
FIG. 1 illustrates an anode window and an irradiation surface which are both in the form of an elongated dome.

As shown, the X-ray emitter tube 1 having an axis AA' comprises an envelope 2 having a metallic wall 2' which encloses a vacuum zone. The emitter is provided with a window 3 which is made of a thin shell 4. The shell may be made out of any material which is transparent to X-ray radiation. The shell has an internal face 5 and an external face 6 and is attached to the envelope 2 along a narrow region or zone 7 called the attachment zone. This zone located substantially in a plane 8 which is called the attachment plane of the window. A cathode 9 is connected to a source of high voltage electricity (not shown) and has a surface herein denominated as emission surface 10. An anode 11 which is grounded to the device comprises a thin metallic film or crust applied to the internal surface of the window 3, As show, a sample 12 which is attached to a support (not shown) defines an "irradiation surface" 13 which faces the window 3 of the emitter 1.

It is noted that in each exemplary embodiment, a cavity 14 is provided within the wall of the metal envelope for the circulation of a cooling fluid.

An optional electrode 15 may be provided, which may for example be cylindrical as is shown in FIG. 1. Such an electrode may be used to insure a greater parallelism within the flux of electrons 16 leaving cathode 9 and going towards anode 11.

The window 3 is a thin shell 4 which may for example be made of beryllium. The thickness of the shell 4 must be sufficient to withstand the difference in pressure exerted on both sides of the window, i.e., the difference between vacuum within the envelope 2 and the atomspheric or approximately atmospheric pressure on the exterior of the envelope. The thickness of the shell must also be sufficient to permit removal of the heat which results from the impact of the electrons on the anode 11 towards the cooling circuit 14. By virtue of these two requirements, the thickness of the shell 4 is selected to be between 1 and 2 mm.

The thin metallic shell which makes up the anode 1 is generally applied by evaporation under vacuum of a metal such as for example molybdehum (Mo), silver (Ag) or copper (Cu). The residual deposit must have a thickness of between about 0.002 and about 0.004 mm.

The material or sample is generally made of a block of powder which has been agglomerated in a mold affer the powder had been impregnated with a binder. Depending on the nature of the sample the binders used may be, by way of example, chosen from among the following: Japanese wax, n-butyl methacrylate, powdered cellulose, boric acid or any other conventionally used binders. In the case of numerous materials subjected to analysis, as for example sulfur, a binder is not necessary. When the block of powder has been agglomerated it is subjected to a die which molds it into the shape of a truncated cone. The agglomeration and the molding can alternatively be conducted as a single operation.

FIGS. 1–4 illustrate four longitudinal cross-sectional views of irradiation devices according to the invention which have an X-ray emitter tube or "pencil tube" having a hot cathode and an anode window in the shape of an elongated dome. An irradiation surface having the shape of a dome is provided in a sample block prepared in the manner indicated above.

In FIG. 1, the external face 6 of anode window 3 and the irradiation surface 13 are each in the form of elongated domes such as for example parabolic or ellipsoid domes.

Figure 2:
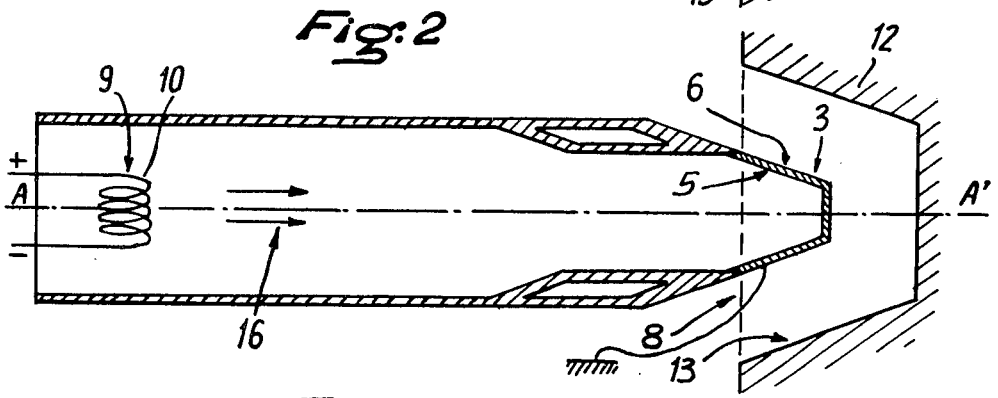
FIG. 2 illustrates an anode window and an irradiation surface which are both in the form of truncated cones.

In FIG. 2, the internal face 5 and external face 6 of the anode window 3 as well as the irradiation surface 13 are each in the form of a truncated cone with minor bases having the shape of a dome.

Figure 3:
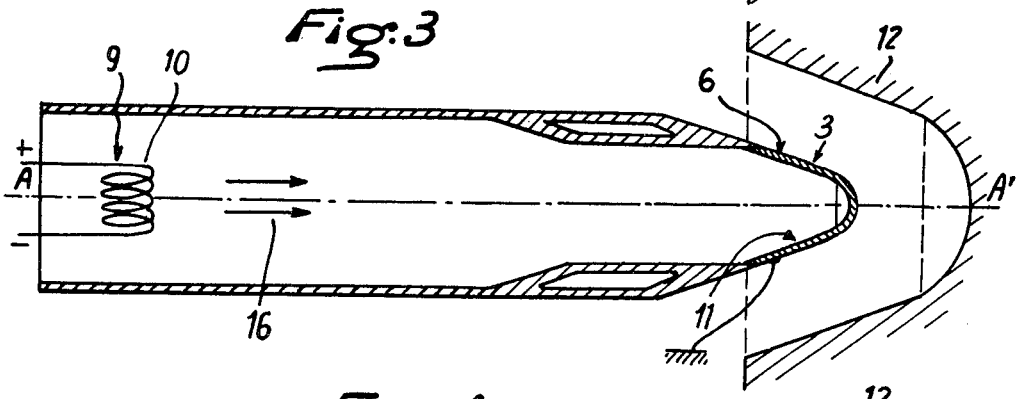
FIG. 3 illustrates an anode window and irradiation surface in the form of truncated cones whose minor bases are convex.

In FIG. 3, the internal face 5 and the external face 6 of the anode window 3 as well as the radiation surface 13 are each in the shape of a truncated cone with a minor base in the shape of a dome.

Figure 4:
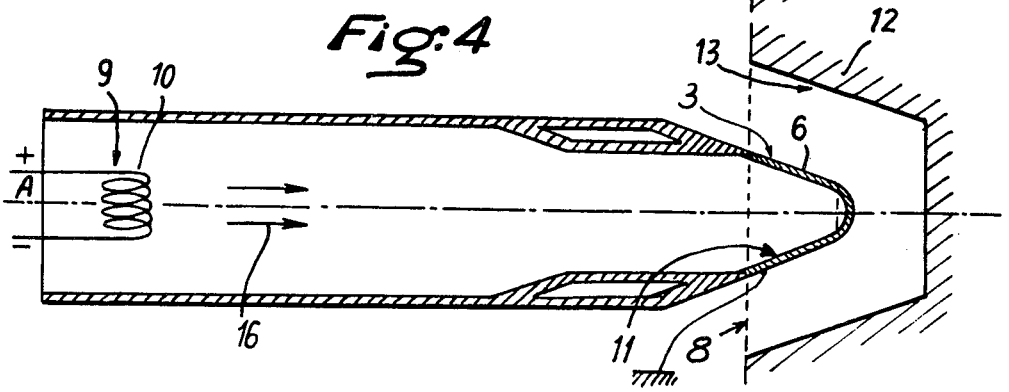
FIG. 4 illustrates an anode window in the form of an elongated dome and a surface of irradiation in the form of a truncated cone.

In FIG. 4, the internal face 5 and the external face 6 of the anode window 4 are each in the shape of a truncated cone with a minor base in the form of a dome. The dome can be attached to the edge of the truncated cone along its minor base. The irradiation surface 13 is in the form of a truncated cone with a planar minor base.

FIG. 1 depicts the trajectory of an electron, e, hitting the internal face of the anode P, this results in X-ray radiation. The radiation traverses the window and very efficiently irradiates the surface of irradiation provided that the said surface is sufficiently extended. The impact of the electron also causes the emission of a backscattered electron, e. As a result of the structure of the elongated dome chosen for the anode, radiation $e_1$ will hit the anode at $P_1$. The impact of $e_1$ at $P_1$ in turn results in the emission of an X-ray designated as $X_1$ as well as backscattered electrons $e_2$.

Although the backscattered electrons $e_1$ have an increased probability of contacting the anode at $P_1$ in the device of the invention, there is only a small probability that the electrons $e_2$ will contact the anode at a point of impact $P_2$ on the anode (not shown).

Clearly, the probability of electrons $e_2$ contacting the anode could be increased if the anode window were to be greatly extended. Yet, in such a case the anode itself would be difficult to fabricate, very costly and very fragile. In any event, the energy of $e_2$ is barely 20% of that possessed by $e_1$. Under these conditions the energy increase realized by virtue of a single impact (of the backscattered electrons) corresponds to 80% of the maximum improvement possible.

Finally, in order to derive the maximum benefit possible out of the "pencil tube" of the invention, it is necessary that the efficiency of the transmission of X-rays between the exterior face 6 of the anode and the irradiation surface 13 be maintained as high as possible. Therefore, two conditions must be fielfilled when positioning the X-ray emitter tube with respect to the irradiation surface.

First, the irradiation surface should extend at least as far as the closed curve resulting from the intersection of the irradiation surface of the sample with the attachment plane of the window. Expressed differently, the anode window 3 must penetrate substantially into the dome which constitutes the surface of radiation.

Second, the corresponding dimensions of the irradiation surface and of the exterior curve of the attachment zone of the window should be in a ratio of between about 1.5:1 and about 5:1, preferably between about 2:1 and 4:1. In the embodiments illustrated by FIGS. 1 to 4 the ratio was chosen to be 2:1.

By using any of the various embodiments of the invention one is able to obtain quasi-monochromatic radiation at a significantly elevated efficiency. Moreover, the improvement in energy efficiency is accompanied by a naturel reduction of the total irradiation energy carried by the continuous ground spectrum which results in an important advantage with respect to the precision of analysis achieved in the diverse methods of X-ray spectrometry.

The drawings and specification present a detailed disclosure of preferred embodiments of the invention. It is to be understood that the invention is not limited to the specific forms and methods disclosed, but rather covers all modifications, changes and alternative constructions and methods falling within the scope of the invention as defined by the claims.

I claim:

1. A device for irradiating a material with X-rays comprising an X-ray emitter which comprises an envelope maintained under vacuum pressure having a window in the form of a thin shell which is made of a material which is substantially transparent to X-rays, said shell being defined by a concave internal face and a convex external face, said shell being attached to said envelope along a relatively narrow attachment zone, said attachment zone being substantially located in an attachment plane of the window, said emitter further comprising a cathode having an emission surface said cathode being adapted to be connected to a high voltage source and an anode, said anode comprising a thin metallic film applied over said internal face of said shell, said emission surface of said cathode as well as said internal and external faces of said window having a common axis of symmetry.

2. The device of claim 1, wherein said shell is in the form of an elongated dome.

3. The device of claim 1, wherein said shell is the form of a frustroconical surface having a major and a minor base, said minor base being covered by a planar surface.

4. In combination, a device for irradiating a material with X-rays comprising an X-ray tube emitter which comprises: an envelope having a vacuum pressure within it; a window made of a thin shell of material which is substantially transparent to X-rays, said shell being defined by a concave internal face and a convex external face, said shell being attached to said envelope along a narrow attachment zone, said attachment zone being substantially located in an attachment plane of the window; a cathode adapted to be connected to a high voltage source, said cathode having an emission surface; a grounded anode, said anode comprising a thin film applied over the inner surface of the window; said device being used in combination with a material to be irradiated, said material being supported by a support, said material further having a concave irradiation surface which faces said window of said X-ray emitter tube;

said emission surface of said cathode as well as the internal and external faces of said window and the irradiation of said material having a common axis of symmetry, said irradiation surface of said material not meeting with said attachment zone of said window.

5. The combination of claim 4, in which the said irradiation surface of said material extends at least as far as the closed curve formed by the intersection of the said irradiation surface of said material with the said attachment plane of said window.

6. The combination of claim 5, in which the ratio between the corresponding dimension of said closed curve and the curve formed by the outer outline of the said attachment zone of said window is between about 1:5:1 and about 5:1.

7. The combination of claim 6, in which the ratio of said corresponding dimensions is between about 2:1 and about 4:1.

8. The combination of claim 4, wherein the said concave internal face and the said convex external face of said window as well as said concave irradiation surface are each in the form of a elongated dome having a continuous surface, the surfaces of both of said domes ending in the said attachment plane of said window.

9. The combination of claim 4, in which said internal and external faces of said window as well as said irradiation surface of said material each has a frustroconical surface having a major and minor base, said major bases both being located substantially in said attachment plane each of said frustroconical sections having a half angle at their apex between about 10° and about 60°, each of said sections having a minor base which is comprised of a planar surface.

10. The combination of claim 4, in which said internal and external faces of said window as well as said irradiation surface of said material are each in the form of a frustroconical surface having a major and a minor base, each of said major bases being located substantially in said attachment plane, each of said frustroconical surfaces having a half angle at its apex of between about 10° and about 60° and a dome which is attached to the frustroconical surface along its minor base.

11. The combination of claim 4, wherein the internal and external faces of said window are each in the form of an elongated dome defining a surface being bounded by a closed curve located in the attachment plane of the window, and wherein the irradiation surface of said material is in the form of a frustroconical surface having a major and a minor base, the major base being located in the attachment plane of said window, said window and said irradiation section each having a half angle of between about 10° and about 60° at its apex, said frustroconical surface having a dome connected along its minor base.

12. The combination of claim 4, in which the internal and external faces of the window as well the surface of radiation of the material are each in the form of closed surfaces being of revolution around an axis of symmetry.

13. The combination of claim 4 wherein said thin film comprises a thin metallic film.

* * * * *